United States Patent [19]

Katagiri et al.

[11] 4,268,595

[45] May 19, 1981

[54] ELECTROSTATIC RECORDING MATERIAL AND METHOD FOR THE PRODUCTION THEREOF

[75] Inventors: Kazuharu Katagiri; Shozo Ishikawa; Shigeto Ohta; Makoto Kitahara, all of Tokyo, Japan

[73] Assignee: Copyer Co., Ltd., Tokyo, Japan

[21] Appl. No.: 91,277

[22] Filed: Nov. 5, 1979

Related U.S. Application Data

[63] Continuation of Ser. No. 887,907, Mar. 17, 1978, abandoned, which is a continuation-in-part of Ser. No. 645,143, Dec. 29, 1975, abandoned.

[30] Foreign Application Priority Data

Dec. 27, 1974 [JP] Japan ..... 49-148575

[51] Int. Cl.[1] ..... G03C 1/87

[52] U.S. Cl. ..... 430/48; 162/138; 260/29.6 RB; 260/29.6 RW; 260/29.6 T; 260/29.6 TA; 427/121; 427/388.4; 427/389.9; 427/391; 428/514; 428/522

[58] Field of Search ..... 430/48; 252/63.7, 64, 252/63.5, 63; 427/385.5, 121, 388.4, 391, 389.9; 162/138; 428/514, 522; 260/29.6 TA, 29.6 T, 29.6 RB, 29.6 RW

[56] References Cited

U.S. PATENT DOCUMENTS

| | | | |
|---|---|---|---|
| 2,999,038 | 9/1961 | Drennen | 427/391 |
| 3,035,004 | 5/1962 | Glavis | 260/29.6 RW |
| 3,079,358 | 2/1963 | Uelzmann | 428/514 |
| 3,248,356 | 4/1966 | Snyder | 260/29.6 TA |
| 3,560,417 | 2/1971 | Pizzi et al. | 428/514 |
| 3,728,314 | 4/1973 | Blank | 260/29.6 TA |
| 3,920,880 | 11/1975 | Akiyama et al. | 427/121 |
| 3,980,602 | 9/1976 | Jakubauskas | 260/29.6 T |
| 4,008,353 | 2/1977 | Gross et al. | 427/391 |
| 4,085,236 | 4/1978 | Ishibashi et al. | 427/121 |
| 4,097,646 | 6/1978 | Kitahara et al. | 427/391 |

*Primary Examiner*—Ralph S. Kendall
*Assistant Examiner*—Thurman K. Page
*Attorney, Agent, or Firm*—Sughrue, Rothwell, Mion, Zinn and Macpeak

[57] ABSTRACT

An electrostatic recording material comprising a support having formed thereon a dielectric layer composed of a terpolymer consisting of (a) methacrylic acid, (b) a monomer selected from the group consisting of (1) acrylic acid esters containing at least 4 carbon atoms and (2) methacrylic acid esters containing at least 5 carbon atoms, and (c) a monomer selected from the group consisting of (1) acrylic acid esters containing at least 4 carbon atoms and (2) methacrylic acid esters containing at least 5 carbon atoms, wherein monomer (b) and monomer (c) are different and at least one of the monomers (b) and (c) is an acrylic acid ester containing at least 11 carbon atoms or a methacrylic acid ester containing at least 8 carbon atoms, and a method for producing an electrostatic recording material, which comprises converting such a terpolymer to a water-soluble or water-emulsifiable salt of the terpolymer in which about 20 to 100 mol% of the carboxyl groups present form a salt with ammonia and/or a volatile amine, dissolving or dispersing the terpolymer salt in water, coating the resulting solution or dispersion onto a support, and drying the coating to volatilize the ammonia and/or volatile amine.

19 Claims, No Drawings

ELECTROSTATIC RECORDING MATERIAL AND METHOD FOR THE PRODUCTION THEREOF

CROSS-REFERENCE TO RELATED APPLICATIONS

This application is a continuation of application Ser. No. 887,907, filed Mar. 17, 1978, which is a continuation-in-part of application Ser. No. 645,143, filed Dec. 29, 1975, both now abandoned.

BACKGROUND OF THE INVENTION

1. Field of the Invention

This invention relates to an electrostatic recording material for a facsimile or a high speed electrostatic printer, such as a dielectric coated paper or a paper for transfer of an electrostatic image. More particularly, this invention relates to an electrostatic recording material for a recording layer of a dielectric coated paper in which an electrostatic latent image is directly formed on a dielectric recording layer by applying an electric change thereto, or of a paper for transfer of an electrostatic image in which an electrostatic latent image previously formed on an electrophotographic plate by an electrophotographic process is transferred to the paper.

2. Description of the Prior Art

Conventional recording papers comprise an electrically conductive layer and a dielectric layer superposed thereon on one surface of a base paper and an electrically conductive layer on the outer surface of the base paper. Materials used as the dielectric layer are highly insulating resins, e.g., organic solvent type resins such as silicone resins, epoxy resins, polyvinyl acetal resins, vinyl acetate resins, vinyl chloride, resins, and styrene-butadiene copolymers. These resins are generally dissolved in an organic solvent and coated on a base paper.

The dielectric layer must have a high surface inherent electrical resistance, e.g., higher than about $10^{10}\ \Omega$, even under conditions of high temperature and high humidity, and, therefore, the above-described organic solvent type resins have heretofore been commonly utilized as a component of such dielectric layers.

However, the use of the above organic solvent type resins is disadvantageous due to the danger of ignition or explosion during coating thereof, and most of these organic solvents are toxic to humans. Therefore, the use of the organic solvent type resins requires specific equipment for the safety of the operators and for the recovery of the solvents used in order to prevent environmental pollution.

In addition, it is necessary to provide an under-coat layer as a barrier coating on a base paper prior to coating of a solution of an organic solvent type resin to prevent penetration of the solvent used into the paper.

In view of the above, attempts have been made to use water-soluble or -emulsifiable resins as a dielectric material in order to eliminate the above-described disadvantages associated with the use of organic solvent type resins.

Generally, water-soluble or -emulsifiable resins do not penetrate into base papers so that a barrier coating to prevent the dielectric coating material from penetrating into the base paper is not required.

However, there are also some problems in the use of water-soluble or -emulsifiable resins as a dielectric material, and, thus, these resins have not yet been practically used for producing dielectric coated materials.

U.S. Pat. No. 3,920,880 discloses an electrostatic recording material having a dielectric layer comprising a Copolymer A of (a) a carboxyl group-containing ethylenically unsaturated monomer, and (b) an ethylenic monomer or a conjugated diolefin and a Copolymer B of (a') an ethylenic monomer or conjugated diolefin, and (b') an amine solution of (i) a carboxyl group-containing unsaturated monomer and (ii) an ethylenic monomer or conjugated diolefin.

U.S. Pat. No. 3,920,880 teaches, as a representative example, a dielectric layer comprising ethyl acrylate, styrene, methyl methacrylate and methacrylic acid. While U.S. Pat. No. 3,920,880 discloses water-soluble resins, these water-soluble resins are always used in conjunction wth a water-insoluble resin.

One of the disadvantages of the water-soluble or -emulsifiable resins is that most of the resins are, in general, more hydrophilic than the organic solvent type resins, and, therefore, they are hygroscopic under high humidity conditions. Thus, deterioration of the charging characteristics of the dielectric layer results.

Another problem associated with the use of water-soluble or -emulsifiable resins is that surface active agents, e.g., emulsifying agents used in preparing a coating liquid of the resin, adversely affect the charging characteristics of a layer formed therefrom.

SUMMARY OF THE INVENTION

One object of this invention is to provide an electrostatic recording material having superior charging characteristics even under high temperature and high humidity conditions, and a method for producing such an electrostatic recording material which permits easy coating of a dielectric layer and does not give rise to serious problems such as toxicity to humans or the risk of fire or explosion.

The above object is achieved by forming on a support a dielectric layer comprising a terpolymer which comprises (a) methacrylic acid, (b) a monomer selected from the group consisting of (1) acrylic acid esters containing at least 4 carbon atoms and (2) methacrylic acid esters containing at least 5 carbon atoms and (c) a monomer selected from the group consisting of (1) acrylic acid esters containing at least 4 carbon atoms and (2) methacrylic acid esters containing at least 5 carbon atoms, wherein monomer (b) and monomer (c) are different, and at least one of the monomers (b) and (c) is an acrylic acid ester containing at least 11 carbon atoms or a methacrylic acid ester containing at least 8 carbon atoms, which terpolymer contains at least one free carboxyl group. More specifically, the object is achieved by dissolving or dispersing a water-soluble or water-emulsifiable salt of the above terpolymer in water in which a part or all of the carboxyl group(s) present form a salt with ammonia and/or one or more volatile amines, coating the resulting solution or dispersion on a support, and then drying the coating.

DETAILED DESCRIPTION OF THE INVENTION

The resins used to form the electrostatic recording material of this invention consist essentially of a terpolymer obtained by polymerizing (a) methacrylic acid with (b) a monomer selected from the group consisting of (1) acrylic acid esters containing at least 4 carbon atoms and (2) methacrylic acid esters containing at least 5 carbon atoms and (c) a monomer selected from the group consistin of (1) acrylic acid esters containing at least 4 carbon atoms and (2) methacrylic acid esters containing at least 5 carbon atoms, wherein monomer (b) and monomer (c) are not the same monomer. Thus, the terpolymer of the present invention comprises methacrylic acid and either two different acrylic acid esters, two different methacrylic acid esters or one acrylic acid ester and one methacrylic acid ester.

While not limitative in any fashion, the proportion of the terpolymer which is most preferably present in an aqueous solution or dispersion in accordance with the present invention is from about 5 to 25 weight %, most preferably from 8 to 18 weight %, based on the total aqueous solution or dispersion weight.

The acrylic acid ester monomers (1) used as a component of the terpolymer in this invention are those which contain at least 4, preferably 4 to 21, carbon atoms. Suitable acrylic acid esters are those in which the alcohol residue is derived from an aliphatic alcohol containing at least 1, preferably 1 to 18, carbon atoms. Specific examples include methyl acrylate, ethyl acrylate, n-propyl acrylate, isopropyl acrylate, n-butyl acrylate, tert-butyl acrylate, isobutyl acrylate, n-hexyl acrylate, octyl acrylate, 2-ethylhexyl acrylate, dodecyl acrylate, lauryl acrylate and stearyl acrylate. Acrylic acid esters whose alcohol residue contains an aryl group or an aralkyl group whose alkyl moiety contains 1 to 11 carbon atoms can also be used. Preferred aryl groups are those which contain from 6 to 11 carbon atoms, for example, phenyl or tolyl, and preferred aralkyl groups are those which contain a total of from 7 to 17 carbon atoms, for example, benzyl. Examples of such are phenyl acrylate and benzyl acrylate.

The methacrylic acid ester monomers (2) used as a component of the terpolymer in this invention are those which contain at least 5, preferably 5 to 22, carbon atoms. Suitable methacrylic acid esters are those in which the alcohol residue is derived from an aliphatic alcohol containing at least 1, preferably 1 to 18, carbon atoms. Specific examples include methyl methacrylate, ethyl methacrylate, n-propyl methacrylate, isopropyl methacrylate, n-butyl methacrylate, tert-butyl methacrylate, n-hexyl methacrylate, octyl methacrylate, 2-ethylhexyl methacrylate and lauryl methacrylate. Methacrylic acid esters whose alcohol residue contains an aryl group or an aralkyl group whose alkyl moiety contains 1 to 11 carbon atoms can also be used. Preferred aryl groups are those which contain from 6 to 11 atoms, for example, phenyl or tolyl, and preferred aralkyl groups are those which contain a total of from 7 to 17 carbon atoms, for example, benzyl. Examples of such are phenyl methacrylate and benzyl methacrylate.

At least one of the ester monomers (1) and (2) must be an acrylic acid ester containing at least 11, preferably 11 to 21, carbon atoms or a methacrylic acid ester containing at least 8, preferably 8 to 22, carbon atoms. The presence of these monomers in the terpolymer is specifically important to obtain excellent charging characteristics.

Where two acid esters containing at least 11 carbon atoms, two methacrylic acid esters containing at least 8 carbon atoms and one acrylic acid ester having at least 11 carbon atoms and one methacrylic acid ester having at least 8 carbon atoms are used, it is preferred for the number of carbon atoms for each of the acrylic acid esters and methacrylic acid ester to be 18 or less from the standpoint of solubility of the terpolymer obtained in aqueous ammonia or an amine aqueous solution.

The proportion of methacrylic acid units in the terpolymer is about 10 to about 70 mol %, preferably 15 to 60 mol %, and the proportion of the acrylic/methacrylic acid ester monomer units is about 30 to about 90 mol %, preferably 40 to 85 mol % each based on the total mols of the terpolymer.

In the terpolymer used in this invention, about 20 to 100 mol % (in the latter case, no free carboxyl groups remain) of the carboxyl groups form a salt with ammonia and/or a volatile amine, whereby the salt can be used in the form of an aqueous solution or an aqueous dispersion. As one skilled in the art will appreciate, the number of carboxyl groups is determined by the proportion of methacrylic acid units in the terpolymer. Usually, the solution or dispersion does not contain a surface active agent or an organic solvent, for example, methanol, isopropanol, and the like, but, if desired, a surface active agent or a water-miscible organic solvent can be added in amounts that do not adversely affect the working environment. While not overly limitative, seldom will a water-miscible organic solvent be added in an amount more than 200 weight % based on the weight of the terpolymer and a surface active agent will be added in an amount of several weight % (e.g., 5 wt % or less) based on the weight of the terpolymer.

The number average molecular weight of the terpolymer is from about 2,000 to about 4,000, preferably from 6,000 to 100,000.

As indicated above, the terpolymer (hereinafter, often a methacrylic acid terpolymer) used in this invention is neutralized with ammonia and/or one or more volatile amines to provide an aqueous solution or emulsifiable aqueous dispersion of the terpolymer salt.

It is to be specifically noted that the exact pH value of the aqueous solution or dispersion is not overly important, i.e., one merely adds a sufficient amount of alkali to dissolve the terpolymer(s) present, insuring that sufficient alkali is added so that about 20 to 100 mol % of the carboxyl groups are converted to the alkali salt form.

While not limitative in any fashion, the proportion of the terpolymer which is most preferably present in an aqueous solution or dispersion in accordance with the present invention is from about 5 to 25 weight %, most preferably from 8 to 18 weight %, based on the total aqueous solution or dispersion weight.

These terpolymers are coated in the form of their ammonium or amine salts wherein about 20 to 100 mol% of the carboxyl groups present in the terpolymer have been converted into the ammonium or amine salt form and are applied to the support as an aqueous solution or an aqueous emulsion of the salt of the terpolymer.

Coating is followed by drying, whereby the ammonia and/or volatile amines used are volatilized, and the main portion of the methacrylic acid terpolymer salt is converted to a terpolymer of methacrylic acid and two different acrylates, of methacrylic acid and two different methacrylates and/or of methacrylic acid, an acrylate and a methacrylate. Typically, substantially complete conversion of the salt is desirable, and generally at least about 90 mol% of the total amount of carboxyl groups in the terpolymer will be converted into free carboxyl groups.

Accordingly, the ammonia and/or amines used to form the methacrylic acid terpolymer salts have the ability to convert the methacrylic acid terpolymers to a form where they are water-soluble or can be emulsified to provide an aqueous dispersion thereof, and are substantially volatilized off upon drying at a temperature of about 130° C. within a period of about 1 minute or less to provide a resin layer having an inherent surface resistivity, at 20° C. and an RH of 65%, of at least about $10^{10}\,\Omega$. Generally, volatilization is efficiently conducted at a temperature of from about 110° to about 150° C. for a time on the order of from about 20 seconds to about 80 seconds.

Examples of the volatile amines which meet these requirements include mono-, di- and tri-alkylamines whose alkyl moiety contains 1 to 4 carbon atoms, such as mono-, di- or tri-methylamine, mono-, di- or tri-ethylamine, mono-, di- or tri-isopropylamine, and mono-, di- or tri-butylamine; and mono-, di- and tri-alkanolamines whose alkyl moiety contains 1 to 4 carbon atoms, such as monoethanolamine, monopropanolamine, monomethyl or dimethyl-ethanolamine, and monomethyl- or dimethyl-isopropanolamine. At least one of ammonia and/or these volatile amines is selected for use to form a salt of the terpolymer. Since the terpolymer used in this invention can thus be used in aqueous form, it lends itself to easy handling and coating, and does not involve the risks encountered in the case of the solvent-type resins described hereinabove, nor does it require expensive equipment to prevent the recited risks.

The coated layer obtained after coating the above resin and drying exhibits very superior charging characteristics that could not be anticipated from conventional resins using water as a medium.

The thickness of the dielectric layer of the dielectric coated papers of this invention suitably ranges from about 2 to about 20$\mu$, more preferably 5 to 12$\mu$.

Generally, when only a resin is used to form the dielectric layer, the coated surface has a gloss peculiar to the resin, and looks different from "natural paper". Thus, the images formed thereon are difficult to see. Furthermore, such a layer is not easily written upon with writing instruments such as pencils, ball-point pens or fountain pens, and it is conventional in the art to add a finely divided powder of, for example, colloidal silica, clay, titanium oxide or calcium carbonate, to the dielectric layer in an amount of about 20 to about 80% by weight based on the solid components of the dielectric layer, to thereby inhibit gloss and improve writability.

Electrostatic recording papers are charged to form an electrostatic latent image thereon by applying a potential of about 200 to about 1,000 V to the dielectric layer when electrodes are used for charging. Recording papers desirably used have superior dielectric characteristics. Recording papers which have low dielectric characteristics require a high voltage power source for charging. When copying papers having superior dielectric characteristics are used for the transfer of an electrostatic image, photosensitive materials which require relatively low potential power sources can be used. The details of the transfer of electrostatic images are described in R. M. Schaffert, *Electrophotography,* Section IV, Focal Press Limited, London, (1965).

The dielectric layer used in this invention is not limited only to methacrylic acid terpolymers. If desired, another aqueous polymer, such as a styrene-butadiene copolymer latex or a polystyrene emulsion, can be mixed therewith in an amount of up to about 40% by weight based on the methacrylic acid terpolymer to form recording papers having various desired end uses.

The present invention has been described predominantly with reference to dielectric coated materials comprising a base paper as a preferred embodiment of a support, but it is to be understood that various types of supports can also be used instead of paper. Examples of such supports include synthetic resin films such as a polyethylene film, a polyester film, a cellulose triacetate film, a cellulose diacetate film, a polycarbonate film, a polyvinyl chloride film, a polystyrene film, a synthetic paper and the like, woven or non-woven fabrics, metal plates or foils, etc. When materials having a low electroconductivity, e.g., less than about $10^{-8}\,\Omega$, for example, synthetic resin films, are used, the support preferably has thereon an electrically conductive layer(s) as hereinafter described in detail.

The term "support" as used herein includes both electrically insulating supports, i.e., paper, synthetic resins, etc., and electrically conductive supports such as metal supports or electrically insulating supports which have been rendered electrically conductive by an appropriate treatment such as impregnation, coating, vacuum deposition, etc., of an electrically conductive material on the support, i.e., to a surface resistance less than about $10^{8}\,\Omega$, which value applies to an electrically conductive support per se. Conventional dielectric coated papers require a barrier layer coating to prevent penetration of the organic solvent used from the dielectric layer to the support (base paper), but such a barrier layer coating is not necessary to the dielectric coated papers of this invention.

Further, in preparing the dielectric material of this invention, the dielectric layer can be directly coated on a support, e.g., a support which is electrically conductive, or on a support having thereon an electrically conductive layer with the electrically conductive layer being present on both sides of the support with the dielectric layer being coated on one of the electrically conductive layers on one side of the support, or with the electrically conductive layer being present on one surface of the support with the dielectric layer being coated on the electrically conductive layer on one side of the support or on the surface of the support opposite the electrically conductive layer on the support.

This invention is further illustrated in greater detail by reference to the following Examples and Comparative Examples. The Examples are not to be construed as limiting the scope of this invention. Unless otherwise indicated, all parts, percents, ratios and the like are by weight and all processings were conducted at atmospheric pressure.

SYNTHESIS EXAMPLE I

Synthesis of Methyl Methacrylate/n-Butyl Methacrylate/Methacrylic Acid Terpolymer (TP-1)

A 200 ml three-necked flask equipped with a stirrer and a condenser was charged with 5.01 g (0.05 mol) of methyl methacrylate, 21.33 g (0.15 mol) of n-butyl methacrylate, 8.61 g (0.10 mol) of methacrylic acid, 43.7 ml of ethanol, and 0.18 g of benzoyl peroxide, and the system was reacted for 4 hours at a bath temperature of 70° to 80° C. while passing nitrogen gas therethrough.

Since the reaction mixture became quite viscous, it was diluted with 200 ml of methyl ethyl ketone to a suitable viscosity. The mixture was then poured into n-hexane. The precipitate obtained was separated by filtration, and dried to provide 31 g of crude product. The crude product was dissolved in 500 ml of methyl ethyl ketone, and reprecipitated from n-hexane to provide 30 g (yield: 86% based on the total amount of the monomers charged) of a terpolymer, TP-1, having a softening point of 125° to 140° C.

The methacrylic acid content of the terpolymer was found to be 22.5% by weight when measured by dissolving 0.3 g of the terpolymer in a mixture of 10 ml of methyl ethyl ketone and 20 ml of ethanol, and titrating it with 1/10 N alcoholic potassium hydroxide using phenolphthalein as an indicator. The viscosity of a solution of the terpolymer dissolved in tetrahydrofuran to a solids content of 10% by weight has measured by means of a viscometer (E type, a product of Tokyo Keiki Co., Ltd.), and found to be 12.1 centipoises (25° C.).

*Synthesis Examples* II–VIII and Comparative Synthesis Examples I and II

By repeating the same procedures described in Synthesis Example I above, except for varying the amounts of monomer and monomers used, various terpolymers, TP-2 and TP-8, of the invention and comparative terpolymers, CTP-1 and CTP-2, described in Table I-1 below were prepared.

Comparative Synthesis Example III

Synthesis of a Four-Component Comparative Copolymer (4P-1) of Methyl Methacrylate/n-Butyl Methacrylate/2-Ethylhexyl Acrylate/Methacrylic Acid A 300 ml three-necked flask equipped with a stirrer and a condenser was charged with 8.01 g (0.08 mol) of methyl methacrylate, 34.13 g (0.24 mol) of n-butyl methacrylate, 14.74 g (0.08 mol) of 2-ethylhexyl acrylate, 18.08 g (0.21 mol) of methacrylic acid, 93.7 ml of methanol and 0.375 g of benzoyl peroxide. The system was reacted for 4 hours at a bath temperature of 70° to 80° C. while passing nitrogen gas therethrough.

The reaction mixture was then diluted with 300 ml of methyl ethyl ketone to a suitable concentration, and poured into n-hexane. The resulting precipitate was separated by filtration and dried to provide 72 g of a crude product. The crude product was dissolved in 1,300 ml of methyl ethyl ketone and then reprecipitated from n-hexane to provide 68 g (yield: 90% based on the total amount of the monomers charged) of a purified copolymer having a softening point of 110° to 125° C. The polymer had a viscosity, as measured in accordance with the method set forth in Synthesis Example I (10% tetrahydrofuran solution), of 17.3 centipoises. The methacrylic acid content of the copolymer measured in the same way as in Synthesis Example I was 24.6% by weight.

Comparative Synthesis Example IV

Under the same conditions as described in Comparative Synthesis Example III above, except for varying the amounts of monomer and preparation conditions, the following comparative copolymer (5P-1) shown in Table I-2 and I-3 below was prepared.

Comparative Synthesis Example V

Synthesis of a Four-Component Comparative Copolymer (4P-2) of Ethyl Acrylate/Styrene/Methyl Methacrylate/Methacrylic Acid (corresponding to Example No. 6 of U.S. Pat. No. 3,920,880)

Into a 300 ml three-necked flask equipped with a stirrer and a condenser were charged 114 ml of benzene, 20.0 g (0.20 mol) of ethyl acrylate, 30.0 g (0.29 mol) of styrene, 25.0 g (0.25 mol) of methyl methacrylate, 25.0 g (0.29 mol) of methacrylic acid and 1.0 g of benzoyl peroxide, and the system was reacted for 3 hours at the reflux temperature while passing nitrogen gas therethrough.

The reaction solution was diluted with ethanol and then poured into n-hexane to obtain a copolymer as a precipitate. The precipitate formed was separated by filtration and dried at 60° C. in vacuum to obtain 75 g of resin, 4P-2, having a number average molecular weight of 51,000 (measured using a Gel Permeation Chromatogram, manufactured by Waters Associates, hereinafter the same).

Resin 4P-2 obtained was analyzed and found to have the following composition:

| | mol % |
|---|---|
| Ethyl Acrylate | 19 |
| Styrene | 28 |
| Methyl Methacrylate | 24 |
| Methacrylic Acid | 28 |

Comparative Synthesis Example VI

Synthesis of a Four-Component Comparative Copolymer (4P-3) of Ethyl Acrylate/Styrene/Methyl Methacrylate/Methacrylic Acid (corresponding to Example 7 of U.S. Pat. No. 3,920,880)

The same procedures as in Comparative Synthesis Example V above were followed, except that 50.0 g (0.48 mol) of styrene and 5.0 g (0.05 mol) of methyl methacrylate were used, to obtain 80 g of resin, 4P-3, having a number average molecular weight of 50,100.

Resin 4P-3 was analyzed and found to have the following composition:

| | mol% |
|---|---|
| Ethyl Arcylate | 20 |
| Styrene | 47 |
| Methyl Methacrylate | 5 |
| Methacrylic Acid | 28 |

TABLE I-1

| Sample No. | Ester Monomer (1) (amt. in mols) | Ester Monomer (2) (amt. in mols) | Amount of* Methacrylic Acid (mols) | Reaction Time (hours) | Yield | Methacrylic Acid Content of Terpolymer (as found; wt%) | Number** Average Molecular Weight | Softening Point (°C.) | *** Viscosity (cps) |
|---|---|---|---|---|---|---|---|---|---|
| Invention | | | | | | | | | |
| TP-1 | Methyl Methacrylate (0.05) | n-Butyl Methacrylate (0.15) | 0.10 (24.6 wt%) | 4.0 | 30 g 86% | 22.5 | 60,300 | 125–140 | 12.1 |
| TP-2 | n-Butyl Methacrylate (0.10) | 2-Ethylhexyl Methacrylate (0.10) | 0.142 (26.4 wt%) | 2.5 | 36 g 78% | 24.8 | 93,800 | 125–138 | 13.4 |
| TP-3 | Ethyl Methacrylate | 2-Ethylhexyl Methacrylate | 0.131 (26.5 wt%) | 5.5 | 38 g 89% | 24.5 | 99,900 | 130–145 | 13.3 |

TABLE I-1-continued

| Sample No. | Ester Monomer (1) (amt. in mols) | Ester Monomer (2) (amt: in mols) | Amount of* Methacrylic Acid (mols) | Reaction Time (hours) | Yield | Methacrylic Acid Content of Terpolymer (as found; wt%) | Number** Average Molecular Weight | Softening Point (°C.) | *** Viscosity (cps) |
|---|---|---|---|---|---|---|---|---|---|
| | (0.10) | (0.10) | | | | | | | |
| TP-4 | n-Butyl Acrylate (0.05) | 2-Ethylhexyl Acrylate (0.15) | 0.138 (25.9 wt%) | 4.0 | 28 g 61% | 30.3 | 57,800 | 75–90 | 13.4 |
| TP-5 | n-Butyl Acrylate (0.067) | n-Butyl Methacrylate (0.133) | 0.073 (10.5 wt%) | 4.0 | 30 g 87% | 18.3 | 70,200 | 65–100 | 14.3 |
| TP-6 | 2-Ethylhexyl Acrylate (0.067) | n-Butyl Methacrylate (0.133) | 0.126 (25.8 wt%) | 4.0 | 37 g 36% | 27.5 | 61,200 | 115–130 | 11.2 |
| TP-7 | 2-Ethylhexyl Acrylate (0.079) | Lauryl Acrylate (0.020) | 0.12 (35.4 wt%) | 1.5 | 21 g 70% | 34.3 | 15,000 | 80–95 | 2.9 |
| TP-8 | n-Decyl Acrylate (0.043) | n-Butyl Methacrylate (0.085) | 0.10 (29.3 wt%) | 5.0 | 26 g 86% | 28.6 | 28,000 | 120–135 | 10.0 |
| Comparison CTP-1 | n-Butyl Acrylate (0.220) | Methyl Methacrylate (0.110) | 0.066 (12.7 wt%) | 4.0 | 39 g 87% | 14.6 | 53,600 | 30–45 | 10.8 |
| CTP-2 | Methyl Acrylate (0.150) | Methyl Methacrylate (0.150) | 0.054 (14.4 wt%) | 3.5 | 27 g 83% | 17.2 | 70,000 | 95–110 | 14.0 |

Note:
*The figures in the parenthesis in the column headed "Amount of Methacrylic Acid (mols)" represent the weight % of methacrylic acid based on the total amount of monomers charged.
**Molecular weight was measured using a GPC-IA measurer (trade mark, produced by Shimazu Seisakusho Ltd., Japan).
***The viscosity was determined for a 10% tetrahydrofuran solution of the polymer as in Synthesis Example 1.

TABLE I-2

| Comparative Sample No. | Ester Monomer (1) (mols) | Ester Monomer (2) (mols) | Ester Monomer (3) (mols) | Ester Monomer (4) (mols) | Other Monomer (mols) | Amount of* Methacrylic Acid (mols) |
|---|---|---|---|---|---|---|
| 4P-1 | Methyl Meth-acrylate (0.08) | n-Butyl Meth-acrylate (0.24) | 2-Ethyl-hexyl Acrylate (0.08) | — | — | 0.21 (24.1 wt%) |
| 4P-2 | Ethyl Acrylate (0.20) | Methyl Meth-acrylate (0.25) | — | — | Styrene (0.29) | 0.29 (24.9 wt%) |
| 4P-3 | Ethyl Acrylate (0.20) | Methyl Meth-acrylate (0.05) | — | — | Styrene (0.48) | 0.29 (24.9 wt%) |
| 5P-1 | Methyl Meth-acrylate (0.06) | n-Butyl Meth-acrylate (0.12) | 2-Ethyl-hexyl Meth acrylate (0.06) | 2-Ethyl-hexyl Acrylate (0.06) | | 0.253 (32.1 wt%) |

*Same as in Table I-1.

TABLE I-3

| Comparative Sample No. | Reaction Time (hours) | Yield | Methacrylic Acid Content of Terpolymer (as found, wt. %) | Number** Average Molecular Weight | Softening Point (°C.) | Viscosity* (cps) |
|---|---|---|---|---|---|---|
| 4P-1 | 4.0 | 68 g 90% | 24.6 | 41,000 | 110–125 | 17.3 |
| 4P-2 | 3.0 | 75 g 75% | 25.0 | 51,000 | 150–166 | 13.1 |
| 4P-3 | 3.0 | 80 g 80% | 24.6 | 50,100 | 155–170 | 14.8 |
| 5P-1 | 3.0 | 60 g 88% | 30.6 | 46,400 | 120–135 | 42.8 |

TABLE I-3-continued

| Comparative Sample No. | Reaction Time (hours) | Yield | Methacrylic Acid Content of Terpolymer (as found, wt. %) | Number** Average Molecular Weight | Softening Point (°C.) | Viscosity* (cps) |
|---|---|---|---|---|---|---|

* & ** Same as in Table I-1.

EXAMPLE 1

The back surface of high quality paper having a basis weight of 0.2 g/m$^2$ was coated with a cationic electrically conducting agent composed of an acrylic acid-type quaternary ammonium salt resin (OKS 3262, trademark for a product of Nippon Synthetic Chemical Industry Co., Ltd.) in an amount of 3 g/m$^2$ after drying. A solution of 11 g of terpolymer TP-1 as shown in Table I-1 above in 62 ml of a 1.1% aqueous ammonium hydroxide solution was coated onto the front surface of the paper using a wire-wound Meyer rod, and dried with hot air at 130° C. for 60 seconds. The amount of the resulting dielectric layer coated was 5.1 g/m$^2$ (dry basis).

The resulting electrostatic recording paper was moistened for 24 hours at a temperature of 20° C. and a relative humidity of 65%, and then subjected to corona discharge to a voltage of +6 KV by a static method using an electrostatic copying paper analyzer (Model SP-428, a product of Kawaguchi Electric Works Co., Ltd.). The paper showed good charging characteristics represented by a maximum surface potential ($V_{max}$) of +53, a potential after 10-second dark decay ($V_{10}$) of +520, and a potential retention after 10-second dark decay ($V_k = V_{10}/V_{max} + 100$) of 97%.

The above recording material was superimposed on a conventional electrophotographic material (composed of an aluminum base with vacuum-deposited selenium formed thereon) on which an electrostatic latent image had been formed by charging to +1,000 V by corona discharge followed by exposure, and the latent image was transferred to the recording material by press rollers. The latent image was then developed with a conventional electrophotographic developer (a developer consisting of $Fe_3O_4$ and a binder, MAGNEDRY IMAGE POWDER (a product of Sumitomo-3M Co., Ltd.)) to form an image of good quality.

Coating solutions were also prepared from the other terpolymers, TP-2 to TP-8 of this invention and Comparative Multicomponent Polymers CTP-1, CTP-2, 4P-1, 4P-2, 4P-3 and 5P-1, shown in Tables I-1 to I-3 above in accordance with the formulations set out in Table II below.

TABLE II

| | Formulations of Coating Solutions | | | |
|---|---|---|---|---|
| Sample | Amount of Copolymer (g) | Amount of 28% Ammonium Hydroxide (ml) | Amount of Water (ml) | Concentration of Copolymer (wt%) |
| Invention | | | | |
| TP-1 | 11 | 2.8 | 60 | 15.6 |
| TP-2 | 10 | 2.7 | 60 | 13.8 |
| TP-3 | 10 | 2.3 | 60 | 13.9 |
| TP-4 | 11 | 2.3 | 60 | 15.1 |
| TP-5 | 10 | 2.3 | 60 | 13.9 |
| TP-6 | 10 | 2.6 | 60 | 13.8 |
| TP-7 | 8 | 4.9 | 67.6 | 10.0 |
| TP-8 | 8 | 4.1 | 45.4 | 14.0 |
| Comparison | | | | |
| CTP-1 | 10 | 2.0 | 60 | 13.9 |
| CTP-2 | 8 | 2.9 | 75 | 9.3 |
| 4P-1 | 10 | 2.7 | 87 | 10.1 |
| 4P-2 | 10 | 1.8 | 88 | 10.1 |
| 4P-3 | 7 | 1.3 | 62 | 10.0 |
| 5P-1 | 10 | 3.7 | 112 | 8.0 |

Each of the coating solutions was coated and dried in the same way as above, and the charging characteristics of the resulting electrostatic recording materials were measured under the same conditions as above. The results obtained are shown in Table III below.

TABLE III

| | Moistened at 20° C. and 65% RH for 24 Hours | | | |
|---|---|---|---|---|
| Sample | coated Amount of Dielectric Layer (g/m$^2$) | $V_{max}$ (+V) | $V_{10}$ (+V) | $V_k$ (%) |
| Invention | | | | |
| TP-1 | 5.1 | 535 | 520 | 97 |
| TP-2 | 5.2 | 575 | 565 | 98 |
| TP-3 | 5.3 | 450 | 410 | 91 |
| TP-4 | 5.7 | 490 | 480 | 98 |
| TP-5 | 5.5 | 510 | 540 | 106 |
| TP-6 | 5.4 | 450 | 440 | 98 |
| TP-7 | 5.5 | 490 | 465 | 95 |
| TP-8 | 5.8 | 520 | 500 | 95 |
| Comparison | | | | |
| CTP-1 | 5.7 | 385 | 270 | 70 |
| CTP-2 | 5.5 | 370 | 230 | 62 |
| 4P-1 | 6.2 | 260 | 150 | 58 |
| 4P-2 | 5.3 | 480 | 460 | 96 |
| 4P-3 | 5.2 | 190 | 190 | 100 |
| 5P-1 | 7.1 | 335 | 215 | 64 |

As a result of moistening, some decrease in maximum surface potential (ΔV) was observed in the electrostatic recording materials in accordance with this invention, but the potential retention was sufficient for practical purposes even under high humidity conditions.

Table IV below shows the charging characteristics of electrostatic recording materials in accordance with this invention under high humidity conditions. The measurement of charging characteristics was made under the same conditions as were employed when the electrostatic recording material was moistened for 24 hours at a temperature of 20° C. and a relative humidity of 65% before measurement.

TABLE IV

| | Moistened at 30° C. and 80% RH for 24 Hours | | | |
|---|---|---|---|---|
| Sample | $V'_{max}$ (+V) | $V'_{10}$ (+V) | $V_k$ (%) | ΔV (V) |
| Invention | | | | |
| TP-1 | 510 | 460 | 90 | −25 |
| TP-2 | 545 | 520 | 95 | −30 |
| TP-3 | 390 | 330 | 85 | −60 |
| TP-4 | 385 | 350 | 91 | −105 |
| TP-5 | 440 | 415 | 94 | −70 |
| TP-6 | 410 | 380 | 93 | −40 |
| TP-7 | 430 | 390 | 90 | −60 |
| TP-8 | 490 | 445 | 91 | −30 |
| Comparison | | | | |
| CTP-1 | 350 | 250 | 71 | −35 |
| CTP-2 | 220 | 100 | 45 | −150 |
| 4P-1 | 230 | 200 | 87 | −40 |
| 4P-2 | 270 | 200 | 74 | −210 |
| 4P-3 | 180 | 170 | 94 | −10 |
| 5P-1 | 300 | 280 | 93 | −35 |

For comparison, the charging characteristics of electrostatic recording materials on which a dielectric layer was formed using commercially available aqueous resins were measured, and the results obtained are shown in Tables V-1 and V-2. It can be seen from the results in these tables that these resins are far inferior to the resins used in this invention in charging characteristics, and are not feasible for practical applications. In forming the materials in Table V-1, the base paper, application rate of all materials, etc., were the same as for forming the materials of the present invention hereinbefore so as to provide a uniform basis for comparison.

TABLE V-1

Charging Characteristics of Commercially Available Aqueous Resins (conditioned for 24 hours at 20° C. and 65% RH)

| Resin | Charging Characteristics $V_{max}$ (volts) | $V_{10}$ (volts) | $V_{10}/V_{max}$ (%) | Coating Amount of Dielectric Layer ($g/m^2$) |
|---|---|---|---|---|
| Acrylic Emulsion (PT850, a product of Teikoku Kagaku) | +66 | +40 | 61 | 5.1 |
| Ethylene/Vinyl Acetate Emulsion (Polysol EVA.P.62, a product of Showa High Polymer Co., Ltd.) | +88 | +36 | 41 | 6.6 |
| Acrylamide Resin (A-230, a product of Sumitomo Chemical Co., Ltd.) | +8 | +2 | 25 | 6.8 |
| Vinyl Acetate-type Emulsion (Movinyl 771H, a product of Hoechst Gosei) | +22 | +2 | 9 | 6.2 |

TABLE V-2

Charging Characteristics under High Humidity Conditions (conditioned for 24 hours at 30° C. and 80% RH)

| Resin | Charging Characteristics $V'_{max}$ (volts) | $V'_{10}$ (volts) | $V'_{10}/V'_{max}$ (%) | $\Delta V$ |
|---|---|---|---|---|
| Acrylic Emulsion (PT850, a product of Teikoku Chemical Industry) | +10 | +1 | 10 | −56 |
| Ethylene/Vinyl Acetate Emulsion (Polysol EVA.P.62, a product of Showa High Polymer Co., Ltd.) | +64 | +16 | 25 | −24 |

$\Delta V = V'_{max} - V_{max}$

EXAMPLE 2

10 g of TP-2 shown in Table I above was dissolved in 90 ml of a 0.7% aqueous ammonium hydroxide solution and 10 g of precipitated calcium carbonate (TS 90, trademark for a product of Nitto Funka Kogyo K.K.) was dispersed in the solution using a homogenizer. The resulting dispersion was coated onto the front face of the same type of back-coated base paper as was used in Example 1 in an amount of 10 $g/m^2$ (after drying), and dried at 140° C. for 60 seconds to form an electrostatic recording paper.

The resulting electrostatic recording paper was subjected to the same image-forming procedure as in Example 1 to form an image of good quality. The paper had low gloss and could be written upon. A potential of −700 V was applied by a type-shaped electrode to the back surface of the recording paper at a pressure of 70 $g/m^2$ for 20 microseconds using a positive electrode for the back surface. The resulting electrostatic latent image was developed with a toner (Toner for Electrostatic Copying Machine 191, a product of Sumitomo-3M Co., Ltd.). Clear typed letters were obtained.

While the invention has been described in detail and with reference to specific embodiments thereof, it will be apparent to one skilled in the art that various changes and modifications can be made therein without departing from the spirit and scope thereof.

What is claimed is:

1. An electrostatic recording material comprising a support having thereon a dielectric layer consisting essentially of a terpolymer consisting of
   (a) methacrylic acid,
   (b) a monomer selected from the group consisting of (1) acrylic acid esters containing at least 4 carbon atoms and (2) methacrylic acid esters containing at least 5 carbon atoms, and
   (c) a monomer selected from the group consisting of (1) acrylic acid esters containing at least 4 carbon atoms and (2) methacrylic acid esters containing at least 5 carbon atoms,
   wherein said monomer (b) and said monomer (c) are different and at least one of said monomers (b) and (c) is an acrylic acid ester containing at least 11 carbon atoms or a methacrylic acid ester containing at least 8 carbon atoms,
   wherein said acrylic acid esters and methacrylic acid esters are esters of alcohols selected from the group consisting of aliphatic alcohols, aromatic alcohols and alcohols containing an aralkyl group and
   wherein the proportion of (a) to the total of (b) and (c) is 10–70 mol % (a) and 30–90 mol % (b) plus (c).

2. The electrostatic recording material of claim 1, wherein the dielectric layer contains particulate material which reduces the gloss thereof.

3. The electrostatic recording material of claim 2, wherein the particulate material is colloidal silica, titanium oxide, calcium carbonate or clay.

4. The electrostatic recording material of claim 1, wherein the dielectric layer further contains at least one polymer selected from the group consisting of a styrene/butadiene copolymer and polystyrene blended therein.

5. The electrostatic recording material of claim 1, wherein said dielectric layer further contains an aqueous polymer other than said terpolymer in an amount of up to 40 weight % based on the amount of said terpolymer.

6. The electrostatic recording material of claim 1, wherein the number average molecular weight of said terpolymer is 2,000 to 400,000.

7. The electrostatic recording material of claim 1, wherein said terpolymer contains methacrylic acid in an amount of 10 to 70 mol % based on the total number of monomer units within the terpolymer.

8. An electrostatic recording material comprising a support having thereon a dielectric layer consisting essentially of a resin component, said resin component consisting essentially of a terpolymer consisting of
   (a) methacrylic acid,
   (b) a monomer selected from the group consisting of (1) acrylic acid esters containing at least 4 carbon atoms and (2) methacrylic acid esters containing at least 5 carbon atoms, and
   (c) a monomer selected from the group consisting of (1) acrylic acid esters containing at least 4 carbon atoms and (2) methacrylic acid esters containing at least 5 carbon atoms, wherein said monomer (b) and said monomer (c) are different and at least one of said monomers (b) and (c) is an acrylic acid ester containing at least 11 carbon atoms or a methacrylic acid ester containing at least 8 carbon atoms,
   wherein said acrylic acid esters and methacrylic acid esters are esters of alcohols selected from the group consisting of aliphatic alcohols, aromatic alcohols and alcohols containing an aralkyl group, and wherein the proportion of (a) to the total of (b) and (c) is 10–70 mol% (a) and 30–90 mol% (b) plus (c).

9. The electrostatic recording material of claim 8, wherein said resin component consists essentially of said terpolymer and wherein said dielectric layer further contains an aqueous polymer other than said terpolymer.

10. The electrostatic recording material of claim 8, wherein said resin component consists of said terpolymer.

11. The electrostatic recording material of claim 8, wherein said resin component consists of said terpolymer and said dielectric layer additionally contains an aqueous polymer other than said terpolymer.

12. A method for producing an electrostatic recording material which comprises dissolving or dispersing in water a water-soluble or water-emulsifiable salt of a terpolymer consisting of (a) methacrylic acid, (b) a monomer selected from the group consisting of (1) acrylic acid esters containing at least 4 carbon atoms and (2) methacrylic acid esters containing at least 5 carbon atoms, and (c) a monomer selected from the group consisting of (1) acrylic acid esters containing at least 4 carbon atoms and (2) methacrylic acid esters containing at least 5 carbon atoms, wherein said monomer (b) and said monomer (c) are different and at least one of said monomers (b) and (c) is an acrylic acid ester containing at least 11 carbon atoms or a methacrylic acid ester containing at least 8 carbon atoms, wherein said acrylic acid esters and methacrylic acid esters are esters of alcohols selected from the group consisting of aliphatic alcohols, aromatic alcohols and alcohols containing an aralkyl group, and wherein the proportion of (a) to the total of (b) and (c) is 10–70 mole% (a) and 30–90 mol% (b) plus (c) in which about 20 to 100 mol% of the carboxyl groups present are in the form of a salt with ammonia and/or a volatile amine; coating the resulting solution of dispersion onto a support; and drying the resulting coating to volatilize the ammonia and/or volatile amine.

13. The method of claim 12, wherein the volatile amine is an alkylamine containing 1 to 4 carbon atoms and/or an alkanolamine containing 1 to 4 carbon atoms.

14. A method for producing an electrostatic recording material which comprises dissolving or dispersing in water a resin component, said resin component consisting of a water-soluble or water-emulsifiable salt of a terpolymer consisting of (a) methacrylic acid, (b) a monomer selected from the group consisting of (1) acrylic acid esters containing at least 4 carbon atoms and (2) methacrylic acid esters containing at least 5 carbon atoms, and (c) a monomer selected from the group consisting of (1) acrylic acid esters containing at least 4 carbon atoms and (2) methacrylic acid esters containing at least 5 carbon atoms, wherein said monomer (b) and said monomer (c) are different and at least one of said monomers (b) and (c) is an acrylic acid ester containing at least 11 carbon atoms or a methacrylic acid ester containing at least 8 carbon atoms, wherein said acrylic acid esters and methacrylic acid esters are esters of alcohols selected from the group consisting of aliphatic alcohols, aromatic alcohols and alcohols containing an aralkyl group, and wherein the proportion of (a) to the total of (b) and (c) is 10–70 mol % (a) and 30–90 mol % (b) plus (c) and an aqueous polymer other than said terpolymer.

15. An electrostatic recording process which comprises electrostatically forming a latent image on the electrostatic recording material of claim 1 and thereafter developing said electrostatic latent image to form a visible image.

16. The electrostatic recording material of claim 1, wherein the molar ratio of monomer (b) to monomer (c) is 1:3 to 4:1.

17. The electrostatic recording material of claim 8, wherein the molar ratio of monomer (b) to monomer (c) is 1:3 to 4:1.

18. The method of claim 12, wherein the molar ratio of monomer (b) to monomer (c) is 1:3 to 4:1.

19. The method of claim 14, wherein the molar ratio of monomer (b) to monomer (c) is 1:3 to 4:1.

* * * * *